US007212641B2

(12) United States Patent
Sheplak et al.

(10) Patent No.: US 7,212,641 B2
(45) Date of Patent: May 1, 2007

(54) ELECTROMECHANICAL ACOUSTIC LINER

(75) Inventors: Mark Sheplak, Gainesville, FL (US); Louis N. Cattafesta, III, Gainesville, FL (US); Toshikazu Nishida, Gainesville, FL (US); Stephen Brian Horowitz, Gainesville, FL (US)

(73) Assignee: University of Florida Research Foundation, Inc., Gainesville, FL (US)

( * ) Notice: Subject to any disclaimer, the term of this patent is extended or adjusted under 35 U.S.C. 154(b) by 382 days.

(21) Appl. No.: 10/919,150

(22) Filed: Aug. 16, 2004

(65) Prior Publication Data

US 2005/0013457 A1 Jan. 20, 2005

Related U.S. Application Data

(62) Division of application No. 09/825,299, filed on Apr. 3, 2001, now Pat. No. 6,782,109.

(60) Provisional application No. 60/194,415, filed on Apr. 4, 2000.

(51) Int. Cl.
*H04R 25/00* (2006.01)

(52) U.S. Cl. ..... 381/181; 381/190; 381/431

(58) Field of Classification Search ..... 381/152, 381/171, 173–175, 190–191, 182, 431, 427
See application file for complete search history.

(56) References Cited

U.S. PATENT DOCUMENTS 2,438,926 A 4/1948 Mott
4,242,541 A 12/1980 Ando
4,268,725 A 5/1981 Nakagawa et al.
4,533,795 A 8/1985 Baumhauer, Jr. et al.
5,119,427 A 6/1992 Hersh et al.
5,251,264 A 10/1993 Tichy
5,668,744 A 9/1997 Varadan et al.
6,088,463 A 7/2000 Rombach et al.
6,782,109 B2 * 8/2004 Sheplak et al. ..... 381/191

OTHER PUBLICATIONS

Hersh et al.; Government Report: CR-2904 "Fluid Mechanical Model of the Helmholtz Resonator"; Sep. 1977; 73 pgs.
Hersh et al; "Effect of Grazing Flow on the Acoustic Impedance of Helmholtz Resonators Consisting of Single and Clustered Orifices"; 1979 NASA Contractor Report 3177; 182 pgs.
Motsinger et al. "Design and Performance of Duct Acoustic Treatment"; pp. 165-206.
Bielak et al. "Advanced Turbofan Duct Liner Concepts"; Feb. 1999 NASA/CR-1999-209002; 124 pgs.

* cited by examiner

*Primary Examiner*—Suhan Ni
(74) *Attorney, Agent, or Firm*—Akerman Senterfitt; Neil R. Jetter; Andrew Gust

(57) ABSTRACT

A multi-resonator-based system responsive to acoustic waves includes at least two resonators, each including a bottom plate, side walls secured to the bottom plate, and a top plate disposed on top of the side walls. The top plate includes an orifice so that a portion of an incident acoustical wave compresses gas in the resonators. The bottom plate or the side walls include at least one compliant portion. A reciprocal electromechanical transducer coupled to the compliant portion of each of the resonators forms a first and second transducer/compliant composite. An electrical network is disposed between the reciprocal electromechanical transducer of the first and second resonator.

16 Claims, 8 Drawing Sheets

ELECTROMECHANICAL ACOUSTIC LINER

CROSS-REFERENCE TO RELATED PATENT APPLICATION

This is a divisional application of U.S. application Ser. No. 09/825,299, filed Apr. 3, 2001 now U.S. Pat. No. 6,782,109, which claims the benefit, of provisional U.S. Patent Application Ser. No. 60/194,415, filed Apr. 4, 2000, entitled "SELF-POWERED, WIRELESS, ACTIVE ACOUSTIC LINER."

STATEMENT REGARDING FEDERALLY SPONSORED RESEARCH OR DEVELOPMENT

The United States Government may have certain rights pursuant to NASA Grant No. NAG1-2261.

BACKGROUND OF THE INVENTION

1. Field of the Invention

The present invention relates generally to an acoustic combination responsive to a sound wave, and more particularly, to an acoustic energy reclamation device that extracts energy from the sound wave and an acoustic liner that has an adjustable compliance that can be adjusted to attenuate the sound wave.

2. Background

Passive Liner Technology

Sound-absorbing acoustic panels have been widely utilized in turbofan engines for noise suppression of engine duct noise. These acoustic panels line the engine duct surface and provide an impedance boundary condition for the acoustic modes propagating within the duct. A typical single degree-of-freedom (SDOF) acoustic liner or Helmholtz resonator 50, shown in FIG. 1(A), is composed of a face sheet 10 and honeycomb core 12 with a rigid backing sheet 14. FIG. 1(B) shows an alternative embodiment where Helmholtz resonator 100 is composed of a face sheet 20 and honeycomb core 22 with a rigid backing sheet 24. Face sheets are usually composed of a perforated plate 10 as shown in FIG. 1(A) or woven wire/perforated plate sandwich 20 as shown in FIG. 1(B). The perforated plate face sheet 10 has a flow resistance controlled by percent open area (i.e., number of holes and hole size) and face sheet thickness. Likewise, the woven wire/perforated plate sandwich 20 has a flow resistance (Rayl number) controlled by percent open area (i.e., number of holes and hole size), face sheet thickness, wire size and wire density. The honeycomb core 12 or 22 is composed of cells 16, 26, respectively, which, when bonded to the face sheet 10 or 20, create cavities behind the face sheet 10 or 20. The attachment of an impervious backing sheet 14 or 24 to the honeycomb core 12 or 22, respectively, seals the honeycomb core 12 or 22 so that each cavity is isolated from its neighbors, thereby creating a "locally reactive" liner. The impedance of a conventional, passive SDOF liner 50 or 100 in a given acoustic medium is a function of the device geometry and grazing flow conditions. The effective frequency range of existing passive SDOF acoustic liners is limited to one octave. Typically, these panels are tuned to the turbofan blade-passage frequency of interest.

Multiple degree-of-freedom (MDOF) systems, such as a double-layer liner 200 that is composed of a face sheet 120 and porous septum 122 with a rigid backing sheet 124 as shown in FIG. 2, and bulk (or "globally" reactive) absorbers offer a wider suppression bandwidth (2–3 octaves), but represent a tradeoff in terms of design complexity, structural integrity, size, weight, and cost. As is the case with SDOF liners, the impedance of MDOF liners is also a function of the device geometry and grazing flow conditions. Indeed, bulk-absorber materials do exist that exhibit desirable acoustic characteristics, although none were deemed usable in aircraft engines. This is because these materials showed a strong tendency to absorb hydrocarbons such as jet fuel and hydraulic fluid in fluid absorption tests.

The greatest limitation of passive liner technology is the constraint of fixed impedance for a given geometry. For a given aircraft propulsion system, there will be different optimum nacelle impedance distributions for the differing mean-flow and acoustic source conditions associated with take-off, cut-back, and landing conditions. Existing active liner technology offers the promise of in-situ adjustable liner impedance, but has the associated drawbacks in terms of cost, complexity, and weight.

Active Liner Technology

Active acoustic liners have been studied recently because of their potential to enhance the performance of the passive liners described above. A review of existing technology in this area is briefly summarized here, in which steady bias flow and/or variable-volume Helmholtz resonators are used to increase the effective suppression bandwidth of the liner.

One such study is described in De Bedout, J. M., Franchek, M. A., Bernhard, R. J., and Mongeau, L., "Adaptive-Passive Noise Control With Self-Tuning Helmholtz Resonators," *J. Sound and Vibration*, vol. 202(1), pp. 109–123, 1997, in which a tunable, variable-volume Helmholtz resonator is combined with a robust, simple control algorithm to achieve maximum noise suppression. The robust control algorithm developed for tuning the resonator is a combination of open-loop control for coarse tuning with closed-loop control for precise tuning. The coarse tuning adjusts the resonator volume based on a lumped parameter model, while the precise tuning algorithm uses a gradient-descent-based method to minimize the voltage output of the microphone. One disadvantage of the approach of De Bedout et al. is the difficulty associated with the mechanical implementation of variable-volume resonator (via a sliding wall) in an acoustic liner.

Howe, in "On the Theory of Unsteady High Reynolds Number Flow Through a Circular Cylinder," *Proc. Royal Society of London A*, vol. 366, pp. 205–223, 1979, theoretically modeled the Rayleigh conductivity of circular apertures in thin plates in the presence of mean bias flow through the holes. His work represented an extension of the work of Leppington and Levine as described in "Reflexion and Transmission at a Plane Screen with Periodically Arranged Circular or Elliptical Apertures," *J. Fluid Mech.*, vol. 61, pp. 109–127, 1973, who examined the problem of reflection of sound by a rigid screen perforated by an array of circular or elliptical apertures. In Howe's model, the incident sound interacts with the mean bias flow to produce vorticity fluctuations, the magnitude of which is determined by the Kutta condition at the edge of the aperture to avoid a velocity singularity. The significance of Howe's work is that it showed the promise for noise attenuation via a small amount of mean bias flow through the apertures of an acoustic liner. Hughes and Dowling in "The Absorption of Sound by Perforated Linings," *J. Fluid Mech.*, vol. 218, pp. 299–335, 1990, verified this concept via a series of experiments in a normal impedance tube.

Sun and his colleagues have conducted further experimental studies of perforated liners with bias flow as shown in "Experimental Investigations of Perforated Liners with Bias Flow," *J. Acoust. Soc. Am.*, vol. 106(5), pp. 2436–2441, November 1999, and "Active Control of Wall Acoustic Impedance," *AIAA J.*, 37, No. 7, 825–831, 1999. They found that a bias flow could markedly increase both the absorption coefficient and effective bandwidth of a perforated liner. The improvement is presumably due to the fact that the bias flow increases the acoustic resistance, although the change in the acoustic reactance is slight. Plate thickness is shown to have a major impact on the performance of the liner, changing the reactance and, hence, the natural frequency of the liner. Reasonable agreement is obtained between experimental data and theoretical values derived from the theory of Howe, adapted to account for finite plate thickness. They have also developed a feedback control system to vary liner cavity depth and bias flow rate in order to optimize the absorption coefficient or maintain the desired impedance in a normal impedance tube, independent of sound frequency. Note that their variable-depth cavity is essentially the same as the variable-volume resonator in De Bedout et al. (1997) and therefore has the same disadvantage mentioned above. It is also worth noting that the authors emphasize the need to find a practical way to vary the reactance of the liner in a real application (Zhao & Sun, 1999).

Walker et al. in "Active Resonators for Control of Multiple Spinning Modes in an Axial Flow Fan Inlet," *AIAA paper* 99–1853, 1999 demonstrated an active Helmholtz resonator with an improved absorption bandwidth by adding a controlled volume velocity via a secondary sound source. This was realized by driving a flexible backplate actuator as part of a feedback control system. While a promising technique, this configuration like all active systems as described above requires actuators, sensors, and a feedback controller. Each of these key components requires power and must be linked via a communication system, typically entailing electrical wiring. Depending on the actuation, sensing, and wiring schemes, such a distributed system is often complex and potentially expensive to implement from a power consumption standpoint.

Thus, there is a need to develop a self-powered, wireless, acoustic liner technology with the performance of an active system, yet with the simplicity and reliability of a passive system.

SUMMARY OF THE INVENTION

In accordance with the purposes of this invention, as embodied and broadly described herein, this invention, in one aspect, relates to a combination responsive to a sound wave that can be utilized as an acoustic liner. The combination has a first plate having a passage for allowing a portion of the sound wave to pass through, a second plate having a hole, and a third plate having an adjustable compliance. The second plate is located between the first plate and the third plate such that the hole of the second plate is closed to form a chamber that is in fluid communication with the passage, and the compliance of the third plate is adjustable for altering a resonant frequency of the chamber to achieve a desired noise suppression of the sound wave. In one embodiment of the present invention, the third plate diaphragm having an adjustable compliance, and a material electromechanically coupled to the complaint diaphragm, wherein the material is capable of converting mechanical energy into a form of energy different from mechanical energy or vice versa, and when the material converts a form of energy different from the mechanical energy into mechanical energy, the compliance of the diaphragm is adjusted to alter the resonant frequency of the chamber in response.

In another aspect, the invention relates to a combination responsive to a sound wave that can be utilized as an acoustic energy reclamation device. The combination has a first plate having a passage for allowing a portion of the sound wave to pass through, a second plate having a hole, and a third plate. The second plate is located between the first plate and the third plate such that the hole of the second plate is closed to form a chamber that is in fluid communication with the passage, and the third plate is compliant and responsive to pressure variation in the chamber caused by the sound wave to generate mechanical displacements. In one embodiment of the present invention, the third plate has a diaphragm being compliant and responsive to pressure variation, and a material electromechanically coupled to the complaint diaphragm, wherein the material is capable of converting mechanical energy into a form of energy different from mechanical energy or vice versa, and when the diaphragm generates mechanical displacements responsive to the pressure variation in the chamber, the material converts mechanical energy produced by the mechanical displacements into a form of energy different from the mechanical energy.

In yet another aspect, the invention relates to a combination responsive to a sound wave. The combination has passage means for allowing a portion of the sound wave to pass through, structure means in fluid communication with the passage means for receiving the portion of the sound wave from the passage, and compliant means coupled with the structure means for altering a resonant frequency of the structure means to achieve a desired noise suppression of the sound wave. The compliant means has material means for converting mechanical energy into a form of energy different from mechanical energy or vice versa. When the material means converts a form of energy different from the mechanical energy into mechanical energy, the compliance of the compliant means is adjusted to alter the resonant frequency of the structure means in response.

In a further aspect, the invention relates to a combination responsive to a sound wave. The combination has passage means for allowing a portion of the sound wave to pass through, structure means in fluid communication with the passage means for receiving the portion of the sound wave from the passage, and compliant means coupled with the structure means for responding to pressure variation in the structure means caused by the sound wave to generate mechanical displacements. The compliant means includes material means for converting mechanical energy produced by the mechanical displacements into a form of energy different from the mechanical energy. The combination further includes storage means for storing the form of energy different from the mechanical energy.

In a further aspect, the invention relates to a method of suppressing noise of a sound wave. The method includes the steps of coupling a structure having a chamber to an electromechanical transducer having a tunable impedance, receiving a portion of the sound wave in the chamber of the structure, and adjusting the tunable impedance of the electromechanical transducer to alter a resonant frequency of the chamber to achieve a desired noise suppression of the sound wave. In practicing the present invention, the electromechanical transducer is a transducer selected from the group consisting of a piezoelectric transducer, an electrostatic transducer, an electrodynamic transducer, a magneto strictive transducer, and an electromagnetic transducer.

In yet another aspect, the invention relates to a method of energy reclamation from a sound wave. The method includes steps of coupling a structure having a chamber to compliant means, receiving a portion of the sound wave in the chamber of the structure, generating mechanical displacements in the compliant means responsive to pressure variation in the chamber caused by the sound wave, and converting mechanical energy produced by the mechanical displacements into a form of energy different from the mechanical energy. The method further includes a step of storing the form of energy different from the mechanical energy in an energy storage device.

In a further aspect, the invention relates to a combination responsive to a sound wave. The combination has a first resonator for extracting energy from the sound wave and a second resonator coupled to the first resonator, wherein the second resonator receives energy from the first resonator and attenuates the sound wave. In one embodiment of the present invention, the first resonator has passage means for allowing a portion of the sound wave to pass through, structure means in fluid communication with the passage means for receiving the portion of the sound wave from the passage, and compliant means coupled with the structure means for responding to pressure variation in the structure means caused by the sound wave to generate mechanical displacements. The compliant means has material means for converting mechanical energy produced by the mechanical displacements into a form of energy different from the mechanical energy. The combination further includes storage means for storing the form of energy different from the mechanical energy. The second resonator has passage means for allowing a portion of the sound wave to pass through, structure means in fluid communication with the passage means for receiving the portion of the sound wave from the passage, and compliant means coupled with the structure means for altering a resonant frequency of the structure means to achieve a desired noise suppression of the sound wave.

In a further aspect, the invention relates to a combination responsive to a sound wave. The combination has at least one first resonator for extracting energy from the sound wave, and a plurality of second resonators coupled to the first resonator, wherein each second resonator receives energy from the first resonator and attenuates the sound wave. In one embodiment of the present invention, the at least one first resonator has passage means for allowing a portion of the sound wave to pass through, structure means in fluid communication with the passage means for receiving the portion of the sound wave from the passage, and compliant means coupled with the structure means for responding to pressure variation in the structure means caused by the sound wave to generate mechanical displacements. The compliant means includes material means for converting mechanical energy produced by the mechanical displacements into a form of energy different from the mechanical energy. The combination further includes storage means for storing the form of energy different from the mechanical energy. Furthermore, each second resonator includes passage means for allowing a portion of the sound wave to pass through, structure means in fluid communication with the passage means for receiving the portion of the sound wave from the passage, and compliant means coupled with the structure means for altering a resonant frequency of the structure means to achieve a desired noise suppression of the sound wave. The compliant means includes material means for converting mechanical energy into a form of energy different from mechanical energy or vice versa. When the material means converts a form of energy different from the mechanical energy into mechanical energy, the compliance of the compliant means is adjusted to alter the resonant frequency of the structure means in response.

Thus, in contrast to current techniques that are adaptive and seek to improve the attenuation characteristics of a liner by directly modifying the impedance of one or more of the acoustic components of the liner, a new system and method of impedance tuning is provided by the present invention. One primary element of this liner is a Helmholtz resonator containing a compliant piezoelectric composite backplate that provides acoustical-to-electrical transduction via the mechanical energy domain. Other conservative electromechanical transduction schemes can also be utilized.

The impedance of this liner is not only a function of the acoustical components, but the mechanical and electrical components as well. While this may complicate the impedance function, it provides an opportunity to tune the impedance by varying an electrical filter network. Additionally, more degrees of freedom are added to the system that can be optimized to improve the attenuation bandwidth. In fact, the impedance of this electromechanical acoustic liner takes on the same form and structure as existing multi-layer liners. The impedance of the basic electromechanical acoustic liner, with no electrical components connected, closely parallels a double layer liner. In this liner, the aspects of the impedance typically caused by a second layer are instead due to mechanical components. Because of the piezoelectric transduction, this embodiment can be extended to provide as many degrees of freedom as desired, simply by adding an appropriate electrical network of inductors and capacitors across the electrodes of the piezoelectric material. Thus the benefits of multi-layer liners are achievable with electromechanical acoustic liners according to the present invention.

The impedance of the electromechanical acoustic liner can be tuned in-situ and in real-time. In one embodiment of the present invention, an electromechanical acoustic liner can provide three distinct liner impedance spectrum, each optimized for a specific engine condition, i.e. take-off, cut-back, and landing. This can be achieved with three separate electrical networks coupled to the electromechanical acoustic liner with a simple three-way switch to select the appropriate network.

DETAILED DESCRIPTION OF THE FIGURES OF THE DRAWINGS

The accompanying drawings, which are incorporated in and constitute a part of this specification, illustrate several embodiments of the invention and together with the description, serve to explain the principals of the invention.

FIG. 1A schematically shows a first prior art single degree-of-freedom acoustic liner.

FIG. 1B schematically shows a second prior art single degree-of-freedom acoustic liner.

FIG. 2 schematically shows a prior art multiple degree-of-freedom acoustic liner.

FIG. 3 schematically shows a conventional Helmholtz resonator.

Figure 1:
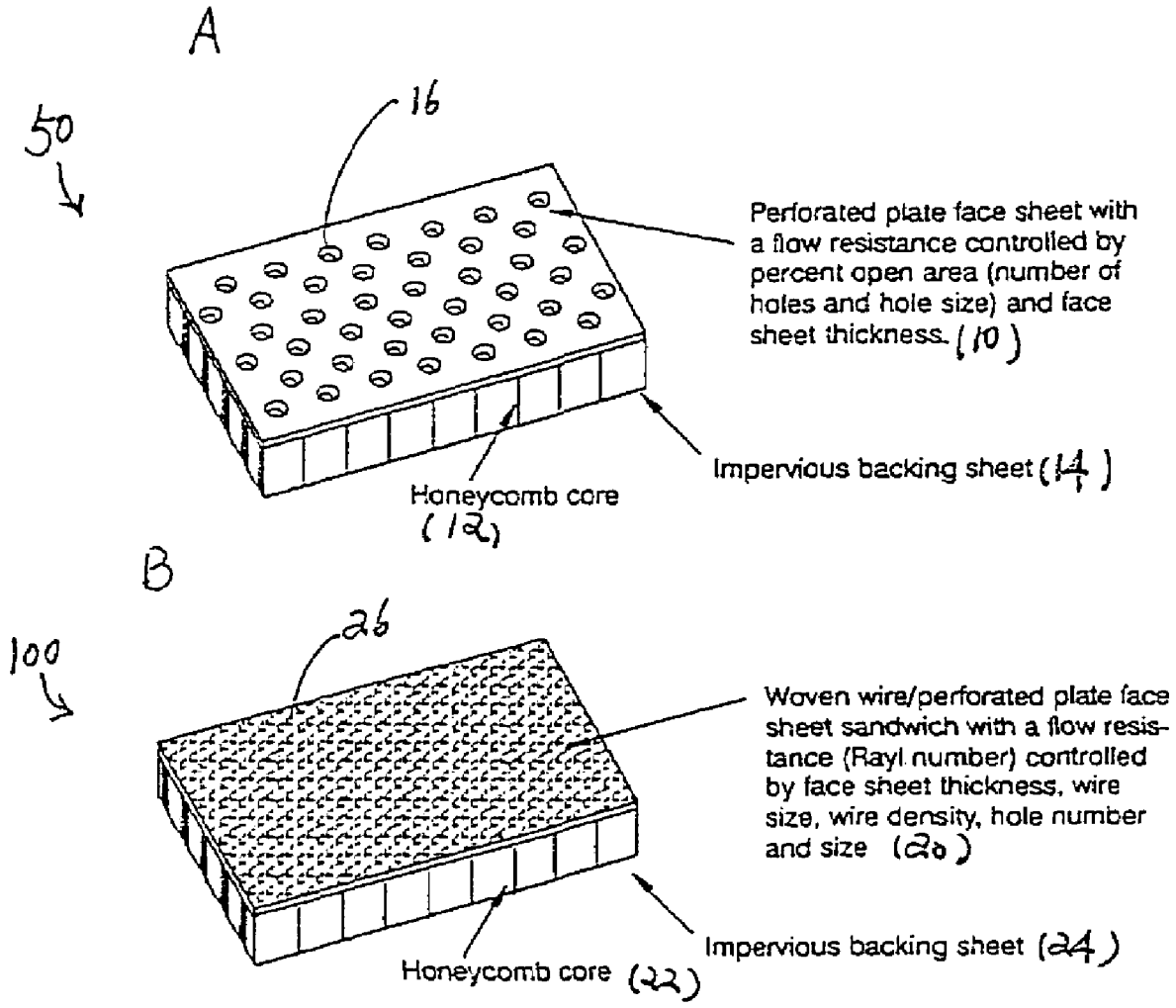
FIGURE 1 (PRIOR ART)
Figure 2:
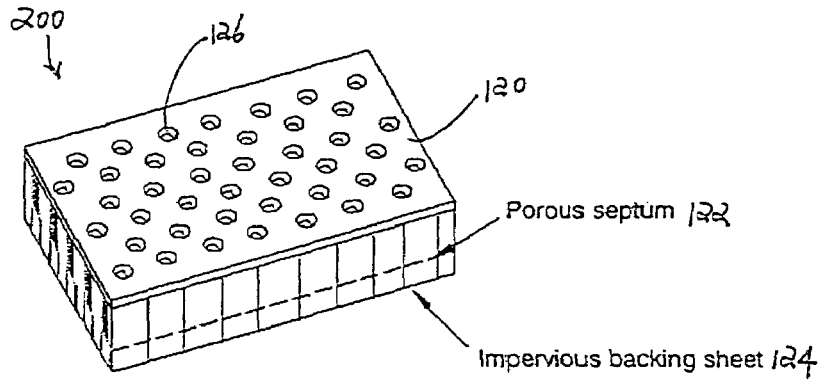
FIGURE 2 (PRIOR ART)
Figure 9:
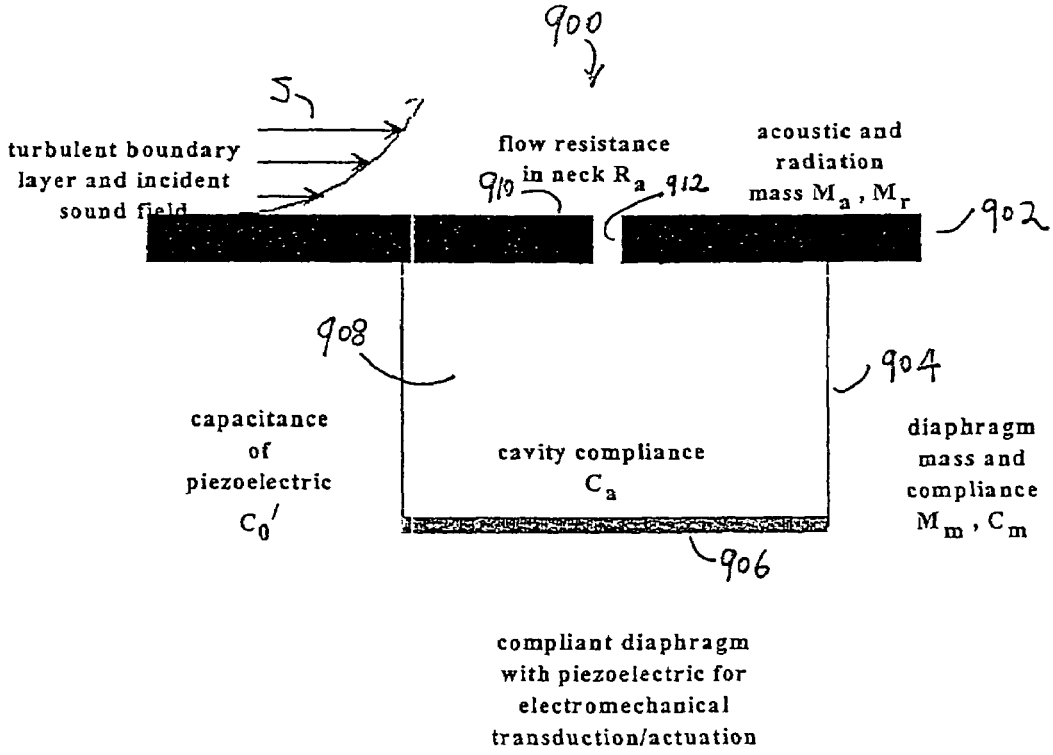

FIG. 9 schematically shows a compliant backplate Helmholtz resonator according to one embodiment of the invention.

Figure 10:
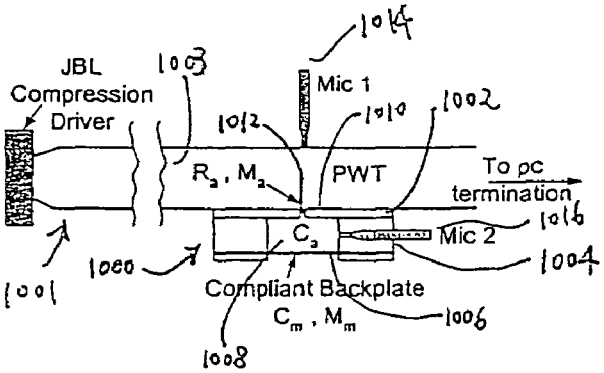

FIG. 10 schematically shows PWT with a flush mounted complaint backplate Helmholtz resonator according to a second embodiment of the invention.

Figure 11:
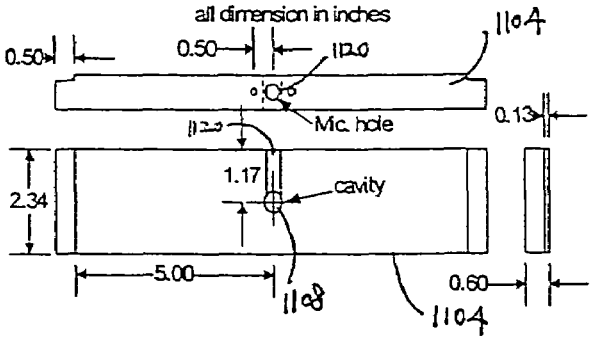

FIG. 11 schematically shows a middle plate that provides the cavity for the Helmholtz resonators of one realization of the invention.

Figure 12:
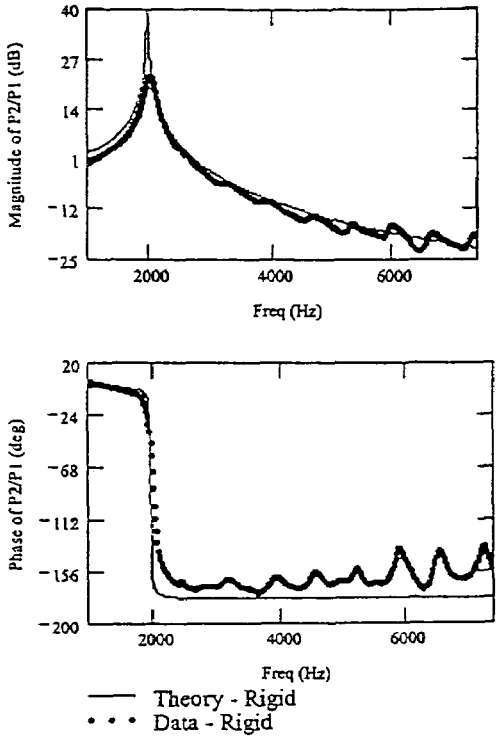

FIG. 12 shows magnitude (upper portion) and phase (lower portion) of the frequency response obtained for the rigid backplate Helmholtz resonator mounted to the PWT.

Figure 13:
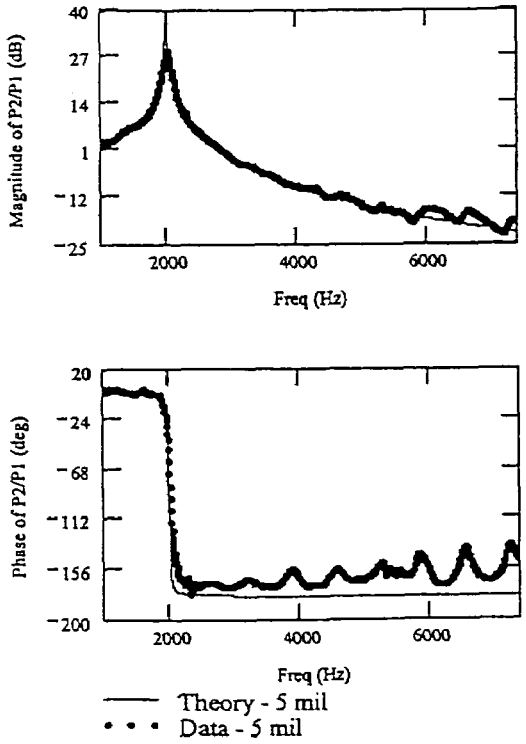

FIG. 13 shows the same as FIG. 12 but for the Helmholtz resonator with the 5 mil backplate.

Figure 14:
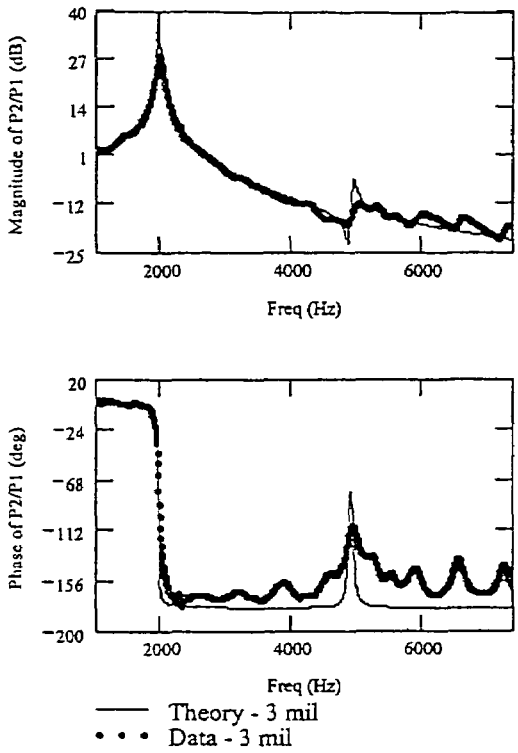

FIG. 14 shows the same as FIG. 12 but for the Helmholtz resonator with the 3 mil backplate.

Figure 15:
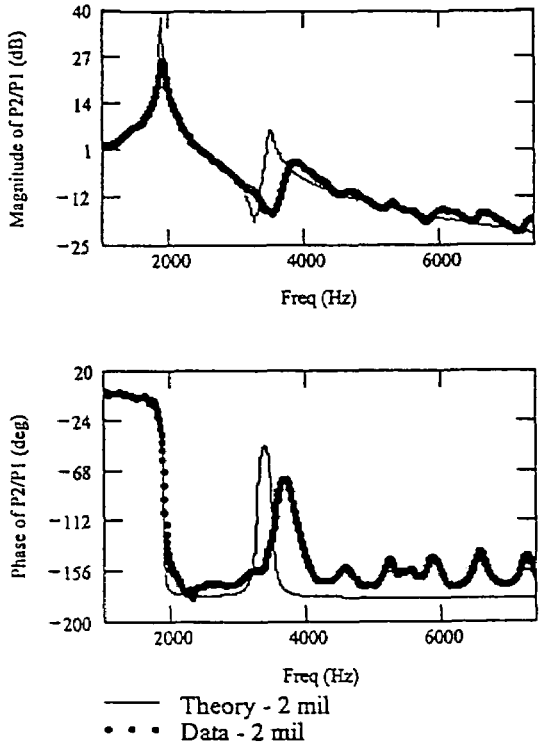

FIG. 15 shows the same as FIG. 12 but for the Helmholtz resonator with the 2 mil backplate.

Figure 16:
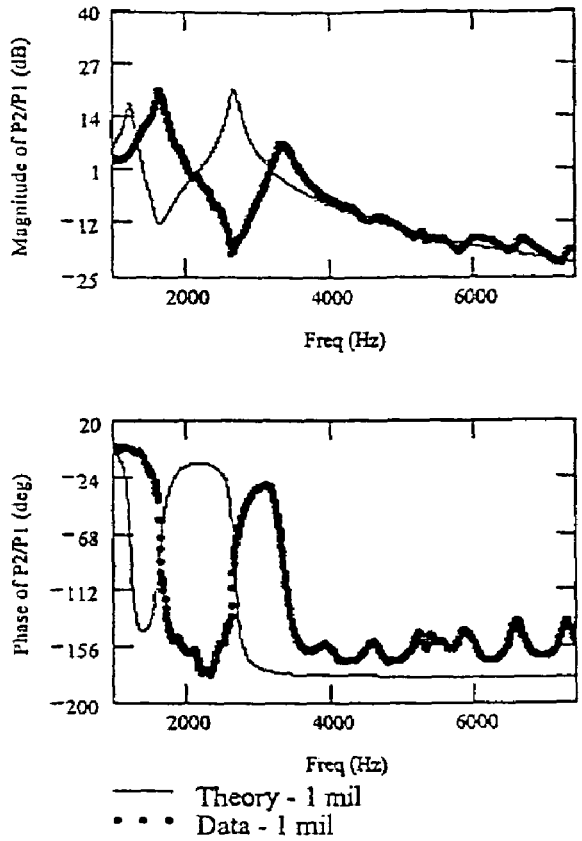

FIG. 16 shows the same as FIG. 12 but for the Helmholtz resonator with the 1 mil backplate.

Figure 17:
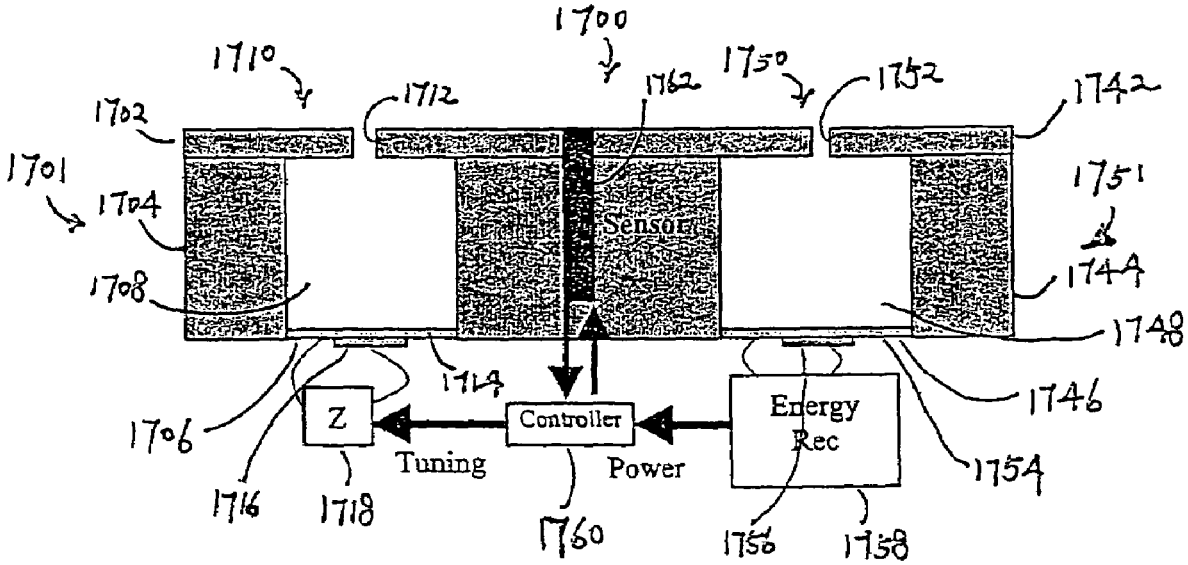

FIG. 17 schematically shows a self-powered, wireless, active liner according to one embodiment of the present invention.

DETAILED DESCRIPTION OF THE INVENTION

The present invention is more particularly described in the following examples that are intended to be illustrative only since numerous modifications and variations therein will be apparent to those skilled in the art. As used in the specification and in the claims, the singular form "a", "an", and "the" include plural referents unless the context clearly dictates otherwise.

Theoretical Aspects of the Invention

Understanding the influence of individual parameters of a given system is critical to efficient and accurate design. An intuitive and analytical understanding of the system is necessary to achieve the desired performance specifications. Furthermore, the design of an electromechanical acoustic liner according to the present invention presents a multi-domain modeling challenge.

Lumped element modeling provides an effective means of analyzing and designing a system involving multiple energy domains. Lumped element modeling has been used in the past for analysis of acoustic liners. The convenience of lumped element modeling lies in the explicit relationship between individual design parameters and the frequency response of the system. Lumped element modeling must be used with care to ensure that necessary assumptions are true. In particular, the wavelength of interest must be significantly larger than the characteristic length scale of the system, for the lumped assumption to be valid. When this criterion is met, the lumped element model is a reasonably accurate model of the distributed physical system. For the design and analysis of rigid and compliant-backplate Helmholtz resonators described in this specification, lumped-element modeling is used extensively.

Conventional Helmholtz Resonator

The dynamic response of a Helmholtz resonator can be conveniently modeled using an equivalent circuit representation. This representation relates mechanical and acoustic quantities to their electrical equivalents. In circuit theory, distributed electrical parameters are lumped into specific components, based on how they interact with energy. Using this criterion, a resistor represents dissipation of energy, while inductors and capacitors represent storage of kinetic and potential energy, respectively.

Figure 3:
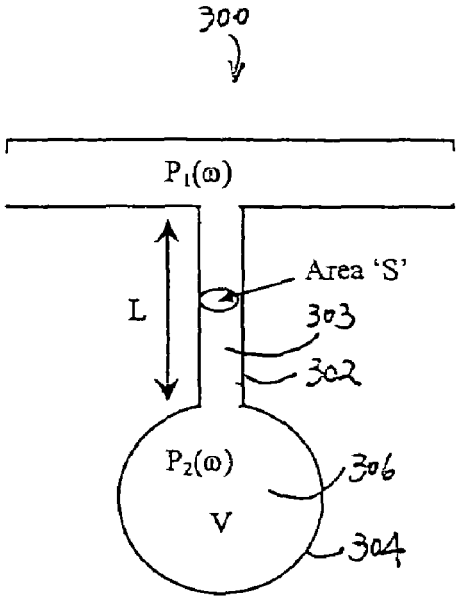

The techniques developed for circuit theory can be applied towards mechanical and acoustical systems by generalizing the fundamental circuit components. A conventional Helmholtz resonator 300 is schematically shown in FIG. 3.

The conventional Helmholtz resonator 300 is a combination responsive to a sound wave that can be lumped into 3 distinct elements. The neck 302 of the resonator defines a pipe or channel 303 through which frictional losses are incurred. Additionally, a portion of the sound wave or air that is moving through the neck 302 possesses a finite mass and kinetic energy, thus the neck 302 has both dissipative and inertive components. The resonator 300 has a structure 304 that has a chamber or cavity 306, wherein the chamber 306 is in fluid communication with the channel 303 to allow the air to be received in the chamber 306. The air in the cavity 306 is compressible and stores potential energy, and can therefore be modeled as a compliance. The structure 304 can have different geometric shapes such as sphere, box, cylinder, or other geometric shapes. Cross-sectionally, the neck 302 can be sherical, oval, square, rectangular, etc.

The acoustic compliance of the cavity, and effective mass of the neck can be derived from first principles. As air or mass flows into the cavity 306, the volume remains constant and so the pressure must rise, by continuity of mass.

$$\frac{dM}{dt} = V\frac{d\rho}{dt} \equiv Q \rightarrow \text{mass flow rate}\left[\frac{\text{kg}}{s}\right] \quad \{1\}$$

If the disturbance is harmonic and isentropic then $$P_2' = c^2\rho' = \frac{c^2 Q}{j\omega V} \quad \{2\}$$

Using the momentum equation in the resonator neck 302, and substituting for $P_2'$ yields the following equation.

$$P_1' = \frac{Qc^2}{j\omega V} + \frac{Qj\omega l}{S} \quad \{3\}$$

Defining the volumetric flow rate as $$q = \frac{Q}{\rho}, \quad \{4\}$$

where ρ is the density of air, yields a relation between the effort $P_1'$ and the flow q as shown below to be $$P_1' = q\left(\frac{1}{j\omega C_a} + j\omega M_a\right). \quad \{5\}$$

In the above expression, the effective compliance $C_a$ of the cavity 306 is $$C_a = \frac{V}{\rho C^2}\left[\frac{m^3}{Pa}\right], \quad \{6\}$$

and the effective mass of the air in the neck 302 is given by $$M_a = \frac{\rho L}{S}\left[\frac{kg}{m^4}\right]. \quad \{7\}$$

The expression given by {5} is viscous damping of air in the neck. The resistance can be approximated from pressure driven, laminar pipe flow $$R = \frac{8\pi\mu l}{S^2}. \quad \{8\}$$

A revised estimate for the effective mass must now be found, since the viscous damping modified the axial velocity profile and the corresponding volumetric flow rate. Taking these new relations into account yields an effective mass of $$M_a = \frac{4\rho L}{3S}\left[\frac{kg}{m^4}\right], \quad \{9\}$$

which is slightly larger than the previous expression. The effective resistance and mass values of the neck are, in fact, non-linear due to turbulence and entrance/exit effects. These are a result of the high sound pressure levels present in the engine nacelle environment. In order to keep this preliminary analysis straightforward and enable interpretation of the results, these non-linear effects will be ignored in this description, along with any grazing flow dependence. These can be incorporated into the model if needed.

Figure 4:
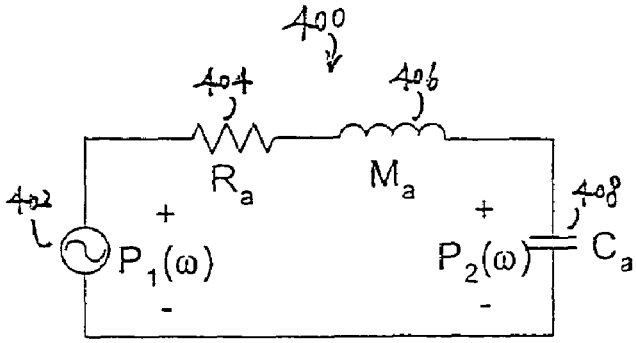
FIG. 4 is an equivalent circuit representation of the conventional Helmholtz resonator shown in FIG. 3.

To create an equivalent circuit model for the Helmholtz resonator 300, one also needs to know how to connect these lumped elements. Connection rules between elements are defined based on whether an effort-type variable or a flow-type variable is shared between them. Whenever an effort variable, such as force, voltage or pressure, is shared between two or more elements, those elements are connected in parallel in the equivalent circuit. Conversely, whenever a common flow (i.e., velocity, current, or volume velocity) is shared between elements, those elements are connected in series. These connection rules are used to obtain the equivalent circuit 400 representation for the Helmholtz resonator 300, as shown in FIG. 4. Specifically, the circuit 400 includes an equivalent power source 402, an equivalent resistor 404, an equivalent inductor 406, and an equivalent capacitor 408.

Figure 5:
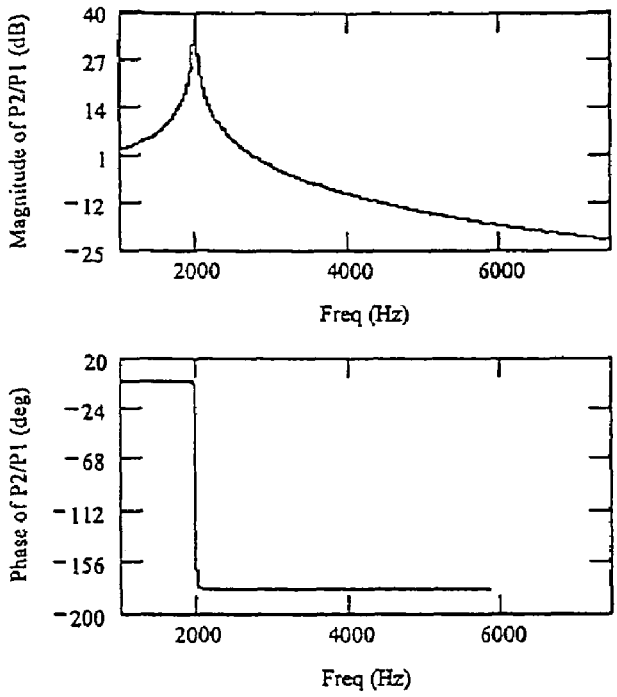
FIG. 5 shows magnitude (upper portion) and phase (lower portion) of theoretical frequency response of a conventional Helmholtz resonator.

The transfer function $P_2/P_1$, represents the pressure magnification of the resonator 300. It is the ratio of cavity pressure to incident pressure. From an analysis of the above circuit 400, a single resonant peak is expected in this transfer function, where the inertance in the neck 302 is canceled out by the compliance of the cavity 306. This is shown in FIG. 5 for a conventional Helmholtz resonator 300 having a neck length and diameter of 3.18 mm and 4.72 mm, respectively, and a cavity volume of 1950 $mm^3$. In FIG. 5, a resonant peak appears at or around 2,000 Hz.

Compliant-Backplate Helmholtz Resonator

Figure 6:
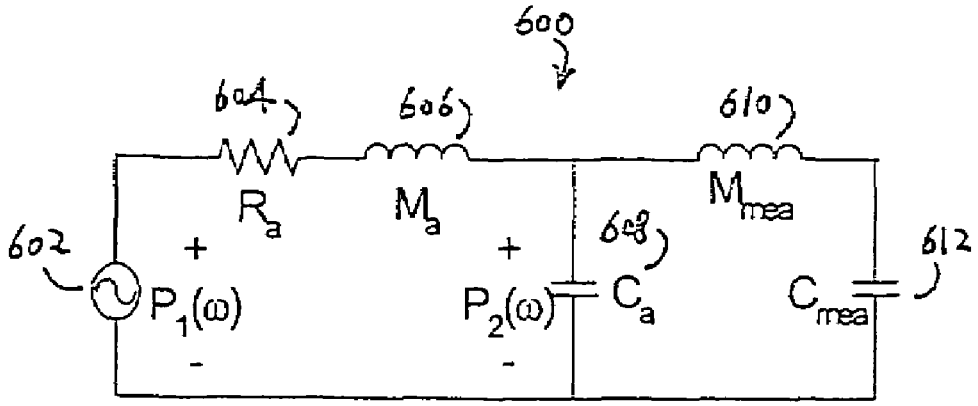
FIG. 6 shows an equivalent circuit representation of a Helmholtz resonator with a compliant backplate.

In the analysis of the conventional Helmholtz resonator 300, it was implicitly assumed that the walls 304 of the cavity 306 were rigid. In the following analysis, the effect of a compliant wall associated with the cavity is examined. When one of the cavity walls or a portion of the structure 304 is thin enough to flex under an applied pressure, the compliance and mass of the thin wall must be accounted for to accurately model the system. This introduces two additional lumped elements 610, 612 to the equivalent circuit 600, as shown in FIG. 6. In one embodiment of the present invention as described in more detail below, a backplate or a bottom portion of the structure 304 is chosen to be compliant, i.e., the backplate or a bottom portion of the structure 304 effectively has a compliance that must be accounted for.

The additional lumped elements 610, 612 are in series with each other because they both are subject to the same motion. Additionally, the series combination of these two elements 610, 612 are in parallel with the acoustic compliance 608. A portion of the air flow entering the cavity 306 through the neck 302 of the resonator 300 will contribute to an increase in cavity pressure, while the remainder of the flow contributes to the motion of the compliant backplate.

The equivalent circuit 600 shown in FIG. 6 is defined in terms of acoustical parameters. To represent the mechanical inertance and compliance of the backplate in the acoustical energy domain requires a transduction factor, given by the squared magnitude of the effective backplate area, $A_{eff}$. The effective area of the backplate can be found by integrating the velocity profile over the surface of the clamped plate. The effective plate area is found to be ⅓ of the physical plate area. The transduction of impedance from the mechanical to acoustical energy domain is given by, $$Z_a = \frac{Z_m}{A_{eff}^2} \quad \{10\}$$

The acoustical equivalent circuit elements of the mechanical inertance and compliance are given by, $$M_{mea} = \frac{M_{me}}{A_{eff}^2} \quad \{11\}$$

$$C_{mea} = C_{me}A_{eff}^2. \quad \{12\}$$

The transduction factor $A_{eff}^2$ relates the impedance of each of the mechanical elements to their acoustical equivalents. This relationship between the acoustical and mechanical energy domains is evident via a dimensional analysis of the systems.

By modeling the compliant backplate as a clamped circular plate, lumped element parameters can then be derived. The physically distributed backplate is lumped into an equivalent mass and compliance at a single point in space. The center of the plate (i.e., where r=0) is chosen as the point about which the system is lumped because of the circular geometry of the plate. The deflection of a clamped circular plate of radius a and thickness h under a uniform pressure P is given by $$w(r) = w_o\left(1 - \left(\frac{r}{a}\right)^2\right)^2 \quad \{13\}$$

where the center deflection $w_a$ is given by $$w_o = \frac{Pa^4}{64D} \quad \{14\}$$

and D, the flexural rigidity, is defined as $$D = \frac{Eh^3}{12(1 - v^2)} \quad \{15\}$$

Additionally, in {15}, E is the elastic modulus, and v is the Poisson's ratio of the material. Similarly, the differential of the plate deflection is given by $$dw(r) = \frac{\partial w(r)}{\partial w(0)}\partial w(0) = \left(1 - \left(\frac{r}{a}\right)^2\right)^2 d\,w(0) \quad \{16\}$$

To find the effective compliance of the backplate, the potential energy stored in the backplate for a given displacement must first be calculated. This can then be equated to the general expression for the potential energy in a spring, where the spring displacement is defined as the center deflection. The potential energy is then given by $$W_{PE} = \frac{w(0)^2 k}{2} \quad \{17\}$$

From this relation, the effective stiffness, which is the inverse of the effective compliance, can be extracted. The potential energy stored in a differential element of the backplate is given by $$dW_{PE} = Fdx = PdAdw = P2\pi rdrdw(r) \quad \{18\}$$

where the pressure P can be found from {14} to be $$P = \frac{64D}{a^4}w(0) \quad \{19\}$$

This yields a total potential energy of $$W_{PE} = \frac{128\pi D}{a^4}\int_0^{w(0)}\int_0^a rw(0)\left(1 - \left(\frac{r}{a}\right)^2\right)^2 d\,rd\,w(0) \quad \{20\}$$

-continued $$= \frac{128\pi D}{a^4}w(0)^2\frac{1}{2} = \frac{1}{2}\frac{w(0)^2}{C_{me}}$$

Thus the effective mechanical compliance of the backplate is found to be $$C_{me} = \frac{3a^2}{64\pi D} = \frac{9a^2(1 - v^2)}{16\pi Eh^3} \quad \{21\}$$

Similar method can be used to compute the effective mass of the compliant backplate. Instead of finding the potential energy, however, the kinetic energy is computed and equated to $$W_{KE} = \frac{1}{2}mu^2 \quad \{22\}$$

where u is the velocity of the backplate and for harmonic motion is given by $$u(r) = \omega w(r). \quad \{23\}$$

The kinetic energy stored in a differential element of the plate is found to be $$dW_{KE}^* = \frac{\rho''}{2}u(0)^2\left(1 - \left(\frac{r}{a}\right)^2\right)^4 2\pi rd\,r \quad \{24\}$$

Integrating this expression, over the area of the plate, yields the total kinetic energy, given by $$W_{KE}^* = \frac{1}{2}\rho'' u(0)^2 2\pi\int_0^a\left(1 - \left(\frac{r}{a}\right)^2\right)^4 rd\,r = \frac{1}{2}u(0)^2\rho''\left(\frac{\pi a^2}{5}\right) \quad \{25\}$$

This yields an effective mechanical inertance of $$M_{me} = \rho''\left(\frac{\pi a^2}{5}\right) = \frac{1}{5}M_{actual}. \quad \{26\}$$

The effective mass of the compliant plate is therefore equivalent to $\frac{1}{5}^{th}$ of the actual mass. Relating the effective mass and compliance to their acoustical representations, yields the following expressions for the effective mass and compliance of the backplate, in the acoustical energy domain.

$$M_{mea} = \left(\frac{\pi a^2\rho''}{5A^2}\right) \quad \{27\}$$

-continued $$C_{mea} = \frac{9a^2(1-\nu^2)A^2}{16\pi E h^3} \quad \{28\}$$

The transfer function of the cavity pressure to the incident pressure is now given by $$\frac{P_2}{P_1} = \frac{\dfrac{s^2 M_{mea} C_{mea} + 1}{s(C'_{me} + s^2 M_{mea} C_{mea} C_a + C_a)}}{R_a + sM_a + \dfrac{s^2 M_{mea} C_{mea} + 1}{s(C_{mea} + s^2 M_{mea} C_{mea} C_a + C_a)}} \quad \{29\}$$

From this expression, the anti-resonance, which occurs at the frequency at which the numerator equals zero, is dependent only upon the effective mass and compliance of the backplate. This makes physical sense, as the anti-resonance of this transfer function is due to the mechanical resonance of the backplate, which prevents sound pressure from building up in the cavity.

Figure 7:
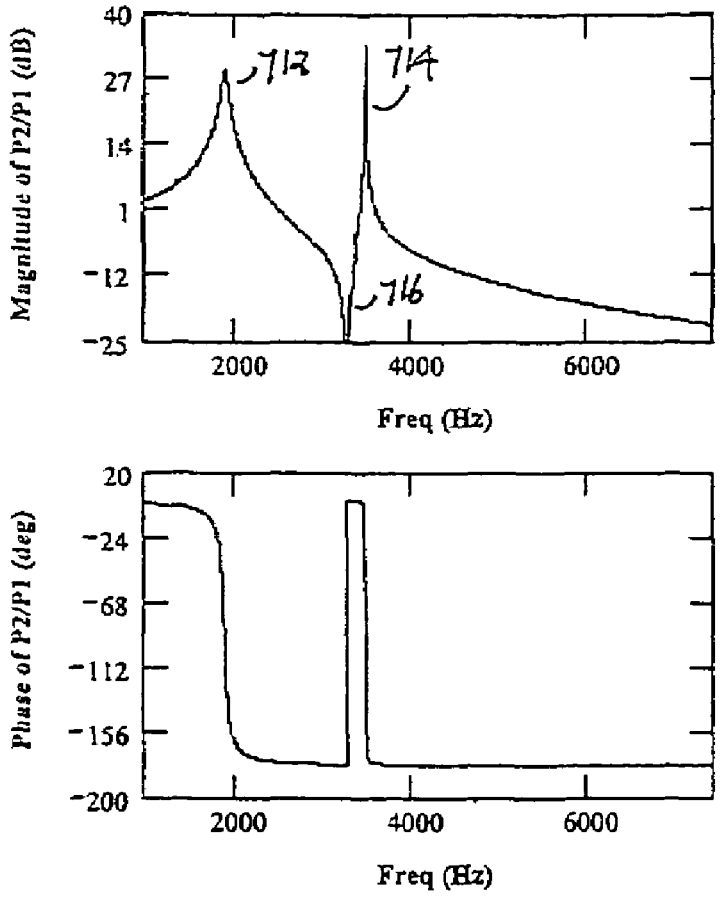
FIG. 7 shows magnitude (upper portion) and phase (lower portion) of the theoretical frequency response of a compliant-backplate Helmholtz resonator.

For a Helmholtz resonator with a compliant backplate having an aluminum shim with 1 mil thickness, but otherwise identical in geometry to the conventional Helmholtz resonator 300 described earlier, a frequency response function is obtained similar to the one shown in FIG. 7. The frequency response shows two resonant peaks 712, 714 separated by an anti-resonance 716.

The input impedance of the compliant-backplate Helmholtz resonator is given by, $$Z_a = \frac{\left(sM_{mea} + \dfrac{1}{sC_{mea}}\right)\dfrac{1}{sC_a}}{sM_{mea} + \dfrac{1}{sC_{mea}} + \dfrac{1}{sC_a}} + sM_a + R_a \quad \{30\}$$

Figure 8:
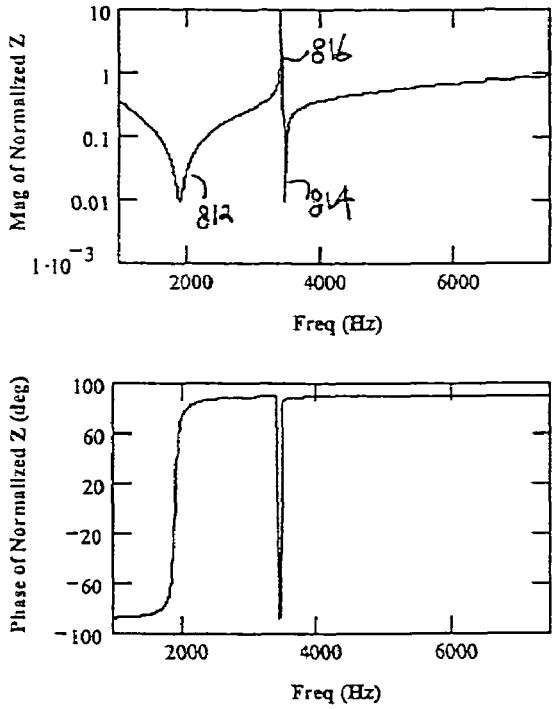
FIG. 8 shows magnitude (upper portion) and phase (lower portion) of the theoretical input impedance of a compliant-backplate Helmholtz resonator.

This expression, which can be derived directly from the equivalent circuit 600, results from a series combination of the backplate mass and compliance in parallel with the cavity compliance and all in series with the mass and resistance of the neck. A plot of the magnitude and phase of the input impedance for a 2 mil backplate is shown in FIG. 8. In the plot, the input impedance is multiplied by the area of the neck $A_n$ to yield the specific acoustic impedance, and is then normalized by ρc.

As can be seen from FIG. 8, there are two resonances 812, 814 in the impedance. At these frequencies, the magnitude tends towards the value of the resistance, since the phase goes to zero and the impedance is then purely resistive.

There is also an anti-resonance 816 in the impedance, which occurs between the two resonant frequencies. It should be noted that, due to the topology of the circuit, this anti-resonance does not coincide with the anti-resonance present in the transfer function of the cavity to incident sound pressure level ("SPL"). As used in this specification, SPL is 20 times the log (base 10) of the r.m.s. ("root-mean-square") pressure fluctuation normalized by a reference pressure. The reference pressure is usually 20 micro-pascals in air which corresponds roughly to the threshold of hearing at 1 khz. This can be understood by looking at the expression for the impedance at the frequency at which the anti-resonance is seen in the transfer function of the cavity to incident SPL. The transfer function heads toward zero at this point because the impedance of the backplate, which is in parallel with the cavity compliance heads toward zero. The total input impedance, however, does not become purely resistive at this point, because of the mass of the neck. Instead, the anti-resonance of the impedance occurs at a higher frequency, where the parallel combination of the backplate impedance and the cavity compliance cancels the impedance of the mass in the neck.

EMBODIMENTS OF THE INVENTION

Apparatus of the Invention

The theoretical aspects, together with the devices presented above, constitute an integral part of the invention, which can be applied to construct, use, and/or analyze apparatus of the invention.

In accordance with the purposes of this invention, as embodied and broadly described herein, this invention, in one aspect, relates to a combination responsive to a sound wave that can be utilized as an acoustic energy reclamation device, an acoustic liner or both. FIGS. 9, 10, 11 and 17 shows several embodiments of the invention.

Referring first to FIG. 9, a combination or a resonator 900 responsive to a sound wave S is shown. The sound wave S has a spectrum of frequencies. Among them, at least some of them are noise components. Each noise component has a frequency or a bandwidth. The combination 900 has a top portion or first plate 902, a side portion or second plate 904 and a bottom portion or third plate 906. The first plate 902 has a neck portion 910 that defines a channel or passage 912 for allowing a portion of the sound wave S to pass through. The second plate 904 has a hole, and the third plate 906 has an adjustable compliance. The second plate 904 is located between the first plate 902 and the third plate 906 such that the hole of the second plate 904 is closed to form a chamber 908 that is in fluid communication with the passage 912. The compliance of the third plate 906 is adjustable for altering a resonant frequency of the chamber 908 to achieve a desired noise suppression of the sound wave by matching the resonant frequency of the chamber 908 substantially to the frequency of noise component to be suppressed. The resonator 900 has a geometric structure similar to that of a traditional Helmholtz resonator; however, the resonator 900 has a complaint plate or portion that is responsive to pressure variation in the chamber 908 caused by the sound wave to generate mechanical displacements.

In another embodiment of the present invention, as shown in FIG. 17, an active liner 1700 includes a first resonator 1701 and a second resonator 1751. Resonator 1701 has a top portion or first plate 1702, a side portion or second plate 1704 and a bottom portion or third plate 1706. The first plate 1702 has a neck portion 1710 that defines a channel or passage 1712 for allowing a portion of the sound wave S (not shown) to pass through. The second plate 1704 has a hole, and the third plate 1706 has an adjustable compliance. The second plate 1704 is located between the first plate 1702 and the third plate 1706 such that the hole of the second plate 1704 is closed to form a chamber 1708 that is in fluid communication with the passage 1712. The first plate 1702, second plate 1704 and third plate 1706 can have same or different geometrical shapes such as rectangular, circular, or oval, etc., be made from same or different materials. They can be individual modular components or an integrated structure formed by, for example, molding.

The bottom portion or the third plate 1706 has a diaphragm 1714 and a material 1716. The diaphragm 1714 has an adjustable compliance, and the material 1716 is electromechanically coupled to the complaint diaphragm 1714. The material 1716 is capable of converting mechanical energy into a form of energy different from mechanical energy or vice versa. When the material 1716 converts a form of energy different from the mechanical energy into mechanical energy, the compliance of the diaphragm 1714 is adjusted to alter the resonant frequency of the chamber 1708 in response.

The diaphragm 1714 can be a thin film having a thickness made from metal or other conductive materials. In one embodiment, the diaphragm 1714 is an aluminum film having a thickness between 0.0001 and 0.01 inches.

The material 1716 can be a piezoelectric material, a dielectric crystal, an electrostatic material, an electrodynamic material, a magnetostrictive material, or an electromagnetic material. In fact, the material 1716 functions as an electromechanical transducer that is selected from the group consisting of a piezoelectric transducer, an electrostatic transducer, an electrodynamic transducer, a magnetostrictive transducer, and an electromagnetic transducer.

In one embodiment as shown in FIG. 17, the material 1716 is piezoelectric, and the form of energy different from the mechanical energy is electrical energy. Furthermore, the piezoelectric material 1716 is electrically coupled to an electrical network 1718. The electrical network 1718 has a variable capacitor (not shown) and a shunt resistor (not shown) which are electrically coupled in parallel. When the variable capacitor is adjusted, the piezoelectric material 1716 receives an electrical energy signal from the electrical network 1718 and converts the electrical energy signal into mechanical energy to adjust the compliance of the diaphragm 1714 to alter the resonant frequency of the chamber 1708 in response. As discussed above, if the resonant frequency of the chamber 1708 substantially matches with a frequency of the sound wave, that frequency component of the sound wave will be suppressed by absorption. In this embodiment, because the capacitance of the variable capacitor (not shown) can be adjusted in a range, the resonator 1701 can be utilized to attenuate unwanted noise in a wide bandwidth or spectrum, which is advantageous over the currently available liner technologies. Note that an electrical network similar to the electrical network 1718 can be utilized together with the resonator 900 so that the resonator 900 is tunable as well.

Still referring to FIG. 9, the top portion or the first plate 902 and the side portion or the second plate 904 can be an integrated structure or separate components such as modular metal plates assembled together. The modular design allows for parts to be interchanged to provide a variety of resonator geometries.

The resonator or the combination responsive to a sound wave according to the present invention can also be utilized as an energy reclamation device. Referring now to FIG. 17, resonator 1751 has a similar structure to that of resonator 1701. Specifically, resonator 1751 has a top portion or first plate 1742, a side portion or second plate 1744 and a bottom portion or third plate 1746. The first plate 1742 has a neck portion 1750 that defines a channel or passage 1752 for allowing a portion of the sound wave (not shown) to pass through. The second plate 1744 has a hole, and the third plate 1746 has an adjustable compliance. The second plate 1744 is located between the first plate 1742 and the third plate 1746 such that the hole of the second plate 1744 is closed to form a chamber 1748 that is in fluid communication with the passage 1752. The bottom portion or the third plate 1746 has a diaphragm 1754 and a material 1756. The diaphragm 1754 has an adjustable compliance, and the material 1756 is electromechanically coupled to the complaint diaphragm 1754. The material 1756 is capable of converting mechanical energy into a form of energy different from mechanical energy or vice versa. When the diaphragm 1754 generates mechanical displacements responsive to the pressure variation in the chamber 1748, the material 1756 converts mechanical energy produced by the mechanical displacements into a form of energy different from the mechanical energy.

The material 1756 can be a piezoelectric material, a dielectric crystal, an electrostatic material, an electrodynamic material, a magnetostrictive material, or an electromagnetic material. In fact, the material 1756 functions as an electromechanical transducer that is selected from the group consisting of a piezoelectric transducer, an electrostatic transducer, an electrodynamic transducer, a magnetostrictive transducer, and an electromagnetic transducer.

In one embodiment as shown in FIG. 17, the material 1756 is piezoelectric, and the form of energy different from the mechanical energy is electrical energy. However, unlike in the resonator 1701 where the material 1716 is electrically coupled to an electrical network 1718, in the resonator 1751, the material 1756 is electrically coupled to a different electrical network 1758. The electrical network 1758 has a rectifying element (not shown) and a switching capacitor (not shown). When the diaphragm 1754 generates mechanical displacements responsive to the pressure variation in the chamber 1748, the piezoelectric material 1756 converts mechanical energy produced by the mechanical displacements into electrical energy in the form of AC signal, the electrical network 1758 converts the AC signal into a DC signal. The electrical network 1758 further comprises a low-loss capacitor (not shown) for storing the DC signal in the form of electrical energy. The electrical network 1758 can take different forms such as a Smalser circuit or a Kymissis circuit as known to those skilled in the art. Optionally, an additional electrical network similar to the electrical network 1718 can be coupled to the material 1756 to tune a resonant frequency of the chamber 1748 to match with a frequency of noise components(s) to optimize energy gain and absorb noise at the same time.

Resonators 1701 and 1751 can be used individually or jointly. As shown in FIG. 17, resonators 1701 and 1751 are part of an active liner 1700. In this embodiment, the active liner 1700 uses a first resonator, i.e., resonator 1751, as an energy reclamation device for extracting energy from sound wave and a second resonator, i.e., resonator 1701, which is coupled to the first resonator 1751, as a noise control device. The resonator 1701 receives energy in the form of electrical power from the resonator 1751 and attenuates the sound wave to suppress noise. Thus, the active liner 1700 provides a self-powered, wireless, active liner device that overcomes many disadvantages associated with current acoustic liner technologies.

Additionally, the active liner 1700 may include an optional sensor 1762 for detecting and sensing the attenuation of the sound wave. Sensor 1762 can be a microphone such as microphone 1016 as shown in FIG. 10. Sensor 1762 is coupled to an optional controller 1760 that is coupled to resonators 1701 and 1751 as well. Controller 1760 includes a frequency-tracking circuit that receives output from the sensor 1762 and provides closed-loop feedback control to the resonator 1701. Controller 1760 and sensor 1762 both can be powered by the resonator 1751.

Moreover, additional resonator(s) similar to the resonators 1701 and 1751 can be introduced into the active liner 1700 to form a device (not shown) that has at least one first resonator for extracting energy from the sound wave, and a plurality of second resonators coupled to the first resonator, wherein each second resonator receives energy from the first resonator and attenuates the sound wave.

The present invention also provides a method of suppressing noise of a sound wave. To do so, one can couple a device such as the resonator 1701 having a chamber to an electromechanical transducer having a tunable impedance, receiving a portion of the sound wave in the chamber of the device, and adjusting the tunable impedance of the electromechanical transducer to alter a resonant frequency of the chamber to achieve a desired noise suppression of the sound wave.

The present invention also provides a method of energy reclamation from a sound wave. To do so, one can couple a device such as the resonator 1751 having a chamber and compliant means to an electromechanical transducer, receive a portion of the sound wave in the chamber of the device, generate mechanical displacements in the compliant means responsive to pressure variation in the chamber caused by the sound wave, and convert mechanical energy produced by the mechanical displacements into a form of energy different from the mechanical energy. The energy reclaimed from the mechanical energy can be stored in an energy storage device such as a capacitor.

Comparable Study of a Conventional Helmholtz Resonator and the Invention

Several resonators according to the present invention were developed for a comparable study of a conventional Helmholtz resonator and the invention. The comparable study was conducted at the Interdisciplinary Microsystems Laboratory at the University of Florida. As shown in FIG. 10, rigid and compliant-backplate Helmholtz resonators such as resonator 1000 were tested in a plane wave tube (PWT) 1001 in the lab. The PWT 1001 contains a 101.5 cm long, 8.5 mm by 8.5 mm square duct 1003. The plane-wave tube 1001 permits characterization in a known acoustic field at frequencies up to 20 kHz.

Frequency response measurements were taken for the conventional Helmholtz resonator, and the compliant-backplate Helmholtz resonator for a range of backplate thicknesses. For each set of measurements, the resonator such as resonator 1000 was mounted flush to the side of the PWT 1001, as shown in FIG. 10. Typically, resonator 1000 has a top portion or first plate 1002, a side portion or second plate 1004 and a bottom portion or third plate 1006. The first plate 1002 has a neck portion 1010 that defines a channel or passage 1012 for allowing a portion of the sound wave (not shown) to pass through. The second plate 1004 has a hole, and the third plate 1006 has an adjustable compliance. The second plate 1004 is located between the first plate 1002 and the third plate 1006 such that the hole of the second plate 1004 is closed to form a chamber 1008 that is in fluid communication with the passage 1012.

Two Bruel and Kjaer (B&K) type 4138 microphones 1014, 1016 were used in testing. One microphone 1016 was flush mounted in the side wall of the resonator cavity or chamber 1008 to measure the cavity pressure. The second microphone 1014 was flush mounted in the wall of the PWT 1001 directly across from the resonator neck portion 1010. This microphone also served as a reference to ensure a constant pressure at the neck portion 1010 of the resonator 1000. The microphones 1014, 1016 were powered by a B&K type 2804 power supply through two B&K type 2669 preamplifiers. The output of the microphones 1014, 1016 was attached to a Stanford Research Systems SRS785 Spectrum Analyzer (not shown), which also served as a signal source. All tests were performed using the band-limited white noise source of the SRS785.

The Helmholtz resonators to be tested were constructed of modular aluminum plates. The modular design allows for parts to be interchanged to provide a variety of resonator geometries. The front plate (not shown) is a 2.34"×10"×0.125" aluminum plate. It contains a single 3/16" diameter, 0.125" deep hole that serves as the resonator neck for both the conventional and compliant backplate Helmholtz resonators. The second or middle plate 1104, as shown in FIG. 11, contains a ½" diameter, 0.6" deep hole 1108 that serves as the resonator cavity. To mount the microphone flush against the wall of this cavity, a tapered hole 1120 was machined from the top of the plate down to the cavity that permitted insertion of the microphone without allowing air to escape.

The backplate (not shown) of the conventional resonator was constructed of a 0.25"×2.34"×4" aluminum plate. It was designed to be rigid and served as a reference against which the compliant backplates will be compared. The compliant backplates (not shown) were also constructed of thin aluminum shim stock. The compliant backplates can be made from other metal films as well. In addition to the rigid backplate, four different compliant backplates were tested, each 1.5"×1.5" and ranging in thickness from 0.005" down to 0.001". Other sizes of the backplates can also be chosen. To provide proper clamping of each compliant backplate, a 0.25" thick, 1.5" diameter ring (not shown) containing a 0.5" diameter hole was mounted to the backside of each compliant sheet and tightened against the middle plate. The rigid ring allowed for an approximation of the compliant sheet as a clamped circular plate.

Conventional Helmholtz Resonator

The frequency response results for the conventional Helmholtz resonator are shown below in FIG. 12. Good correlation was obtained between the theoretical and measured results. The resonant peak occurred at 2 kHz as predicted. However, the peak was slightly more damped than expected. This is most likely due to nonlinear effects in the resistance of the neck. Additional losses occur due to entrance/exit effects and turbulent mixing. At low SPL, the resistance is primarily due to viscous damping by the walls of the neck and the theoretical analysis holds well. At higher SPL, however, this nonlinearity increases and dominates the total resistance. The experimental results shown in FIG. 12, were obtained using an incident SPL of 88 dB to avoid this nonlinearity. Further tests were performed at higher incident SPL and show an increase in the nonlinear damping.

Compliant-Backplate Helmholtz Resonators

After testing the conventional Helmholtz resonator, the rigid backplate was replaced by the thickest of the four compliant backplates, which has a thickness of 5 mil. The measured results obtained for this backplate are shown in FIG. 13. The frequency response of this backplate is similar to that obtained for the rigid backplate. No shift in the resonant peak towards lower frequency is evident. The second resonant peak and anti-resonance exist at a much higher frequency for this backplate, and thus are not visible.

The next compliant backplate tested has a thickness of 3 mil. As shown in FIG. 14, this backplate is sufficiently compliant to see both resonant peaks and the anti-resonance within the frequency range tested. In the frequency response plot shown in FIG. 14, the anti-resonance and second resonance appear and are located at 4860 Hz and 5000 Hz, respectively. As the compliance increases, these peaks will shift closer to the first resonance. This can be seen in FIG. 15, showing the measured results for the 2 mil thick backplate.

From the measured results using the 2 ml thick backplate, the first resonance has clearly shifted below 2 kHz. Furthermore, the anti-resonance, and second resonance have shifted down to 3508 Hz, and 3675 Hz, respectively.

The final compliant backplate to be tested had a thickness of 1 mil. The frequency response data is shown in FIG. 16. With a 1 mil backplate, on the Helmholtz resonator, the data diverges significantly from the theoretical data. The theory predicts a higher anti-resonance, corresponding to a stiffer and/or lighter backplate than predicted. Several possibilities exist for this discrepancy. One possibility is the manufacturing tolerances of the aluminum. This would cause deviations to show up more prominently in the thinner backplates, as the tolerances approach the intended thickness of the backplate. If the tolerance on the thickness is on the order of 0.5 mil, the deviation in frequency response could be significant when the intended thickness is 1 mil. Another possibility for the deviation is non-ideal structural boundary conditions that arise from the backplate mounting. If unintended in-plane tension is being applied to the backplate because of the mounting, the deflection equations of a clamped plate do not hold. Additionally, variations in the material properties of the backplate, and possible violations of small deflection assumptions need to be investigated.

One motivation of the inventors for studying compliant-backplate Helmholtz resonators is their application to active noise control. This requires a thorough characterization of the input impedance of the system. The data presented in this specification utilizes the pressure transfer function because it provides a simple method to validate the model for proof-of-concept purposes. Impedance values can be extracted from this data if so desired. However, an alternative method would be to take impedance measurements directly. Impedance measurements can be performed using a normal-incidence impedance tube.

The invention has been described herein in considerable detail, in order to comply with the Patent Statutes and to provide those skilled in the art with information needed to apply the novel principles, and to construct and use such specialized components as are required. However, it is to be understood that the invention can be carried out by specifically different equipment and devices, and that various modification, both as to equipment details and operating procedures can be effected without departing from the scope of the invention itself. Further, it should be understood that, although the present invention has been described with reference to specific details of certain embodiments thereof, it is not intented that such details should be regarded as limitations upon the scope of the invention except as and to the extent that they are included in the accompanying claims.

We claim:

1. A multi-resonator-based system responsive to acoustic waves, comprising:

a first and at least a second resonator, said first and second resonators each including:

a bottom plate; side walls secured to said bottom plate, and a top plate disposed on top of said side walls, said top plate having an orifice so that a portion of an incident acoustical wave compresses gas in said resonator, said bottom plate or said side walls including at least one compliant portion, and a reciprocal electromechanical transducer coupled to said compliant portion of each of said resonators to form a first and second transducer/compliant composite, and an electrical comprising network disposed between said reciprocal electromechanical transducer of said first and second resonator.

2. The system of claim 1, wherein said first and second resonator are physically coupled through a common portion of said side walls.

3. The system of claim 1, wherein an acoustic impedance of at least one of said transducer/compliant composites is different as compared to an open circuit impedance of said transducer/compliant composite.

4. The system of claim 2, wherein said electrical comprising network comprises a variable capacitor and a shunt resistor connected in parallel coupled to said second reciprocal electromechanical transducer, adjustment of said variable capacitor modifying a resonant response of said second resonator.

5. The system of claim 2, wherein said electrical comprising network includes an AC to DC converter and a switching capacitor, said conversion device converting an AC signal output by said first reciprocal electromechanical transducer into a DC signal.

6. The system of claim 5, wherein said electrical comprising network includes a pathway for transferring energy from said DC signal to said second resonator.

7. The system of claim 1, wherein at least one of said reciprocal electromechanical transducers comprises a piezoelectric material.

8. The system of claim 1, wherein said electrical comprising network includes at least one inductor.

9. The system of claim 1, wherein said electrical comprising network includes at least one active network, said active network dynamically modifying a resonant response of at least one of said first and second resonators.

10. The system of claim 1, wherein at least one of said first and second resonators provides at least one resonance in an audio frequency range.

11. The system of claim 1, wherein said electrical comprising network includes a first electrical network including AC to DC converter coupled to said first reciprocal electromechanical transducer, and a second electrical network coupled to said second reciprocal electromechanical transducer, wherein energy harvested from said first resonator is transferred to said second resonator, said second resonator attenuating said acoustical wave to suppress noise.

12. The system of claim 11, wherein said energy harvested applied to said second electrical network changes at least one resonant frequency of said second resonator.

13. The system of claim 1, further comprising a sensor coupled to said second resonator for detecting and sensing attenuation of said acoustical wave by said second resonator.

14. The system of claim 13, wherein said sensor comprises a microphone.

15. The system of claim 14, wherein said electrical comprising network comprises a controller which includes a frequency-tracking circuit, said controller coupled to an output of said sensor, said controller providing closed loop feedback control to control a resonant response of said second resonator.

16. The system of claim 15, wherein energy from said acoustical wave received by said first resonator provides power said controller and sensor.

* * * * *